US011397065B2

(12) United States Patent
Vanhatalo et al.

(10) Patent No.: US 11,397,065 B2
(45) Date of Patent: Jul. 26, 2022

(54) SILENCER FOR A FIREARM

(71) Applicant: Silention Oy, Oulu (FI)

(72) Inventors: Miika Vanhatalo, Lasikangas (FI); Veikko Valli, Oulu (FI)

(73) Assignee: Silention Oy, Oulu (FI)

( * ) Notice: Subject to any disclaimer, the term of this patent is extended or adjusted under 35 U.S.C. 154(b) by 0 days.

(21) Appl. No.: 17/060,159

(22) Filed: Oct. 1, 2020

(65) Prior Publication Data

US 2021/0102774 A1 Apr. 8, 2021

Related U.S. Application Data

(60) Provisional application No. 62/910,494, filed on Oct. 4, 2019.

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS 3,710,679 A * 1/1973 Werbell, III ..... F41A 21/30 89/14.4
5,773,746 A * 6/1998 Vaden ..... F41A 21/325 181/223
6,385,891 B1 * 5/2002 Rabatin ..... F41A 21/30 42/77
9,891,017 B1 * 2/2018 Lee ..... F41A 21/325
9,927,201 B2 3/2018 Penchuk
10,066,890 B1 9/2018 Lee
10,508,878 B1 * 12/2019 Oglesby ..... F41A 21/34
10,670,362 B2 * 6/2020 Wilson ..... B23K 35/304
10,801,796 B2 * 10/2020 Kras ..... F41A 21/325
10,883,787 B2 * 1/2021 Palu ..... F41A 21/30
2018/0058791 A1 * 3/2018 Larue ..... F41A 21/30
(Continued)

FOREIGN PATENT DOCUMENTS

WO WO-2019102510 A1 * 5/2019 ..... F41A 21/325

OTHER PUBLICATIONS

International Search Report, PCT/FI2021/050189, dated Dec. 2, 2021 (4 pages).

*Primary Examiner* — Joshua E Freeman
*Assistant Examiner* — Benjamin S Gomberg
(74) *Attorney, Agent, or Firm* — Thomas | Horstemeyer, LLP

(57) ABSTRACT

A firearm silencer includes a substantially cylindrical outer sheath having a first end and a second end, a barrel hole in the first end of the outer sheath, a damping element inside said outer sheath and connection means for connecting the silencer to a firearm barrel. The connection means include at least one clamping surface adapted to be pressed against the outer surface of said barrel. Further said connection means comprise a locking frame, at least one mounting lever hingedly connected to the locking frame and a twisting device functionally connected to the mounting lever for turning the mounting lever. At least one clamping surface is integrated to the mounting lever. Functional connection with the twisting device is arranged in a way that the mounting lever can by turned by using the twisting device.

14 Claims, 2 Drawing Sheets

(56) References Cited

U.S. PATENT DOCUMENTS

| | | | | |
|---|---|---|---|---|
| 2019/0154386 | A1 | 5/2019 | Lee | |
| 2019/0154387 | A1* | 5/2019 | Lee | F41A 21/325 |
| 2019/0195589 | A1* | 6/2019 | Lee | F41A 21/325 |

* cited by examiner

SILENCER FOR A FIREARM

This application claims priority of provisional U.S. application No. 62/910,494, filed on Oct. 4, 2019 the content of which is incorporated herein by reference.

TECHNICAL FIELD

Firearm silencer, including a substantially cylindrical outer sheath having a first end and a second end, a barrel hole in the first end of the outer sheath, a damping element inside said outer sheath and connection means for connecting the silencer to a firearm barrel, which connection means include at least one clamping surface adapted to be pressed against the outer surface of said barrel.

BACKGROUND ART

High pressure weapons, such as rifles and shotguns, produce loud report when fired, which can cause immediate and irreparable hearing losses to the shooter and other individuals near the shooter. The report of a gunshot also causes a significant noise pollution. The report of a gunshot can be reduced to an acceptable level by using a firearm silencer, which is attached to the end of the firearm barrel. Silencers, which are also called suppressors, are widely used e.g. by hunters.

Silencers are usually attached to a barrel of a firearm by screwing the internal treads of the silencer onto a threaded barrel. Since most guns have no factory-made threads on the barrel, the owner of the gun has to hire a gunsmith to machine threads onto the barrel. This process is costly and time consuming. Many gun owners do not want to make permanent and visible alterations to their gun, because it may have negative affect to the appearance and value of the gun.

Document US 2019/0154386 A1 discloses a firearm adapter including an attachable or integrated suppressor. The adapter is configured to ensleeve and compress around the barrel. The adapter comprises a tapered constricting sleeve, the inner surface of which is compressed against outer surface of the barrel. A problem with this adapter is, that a considerable amount of force is deeded to compress constricting sleeve tightly around the barrel. Further, due to the limited deformation capacity of the constricting sleeve, a filament sleeve around the barrel is often needed to establish proper amount of compression to ensure that the adapter remains fixed to the barrel during use of the firearm.

An object of the invention is to provide a firearm silencer with which drawbacks and defects relating to the prior art can be reduced.

The object of the invention is achieved with a firearm silencer which is characterized in what is disclosed in the independent patent claim. Some preferred embodiments of the silencer are disclosed in the dependent claims.

BRIEF SUMMARY OF THE INVENTION

The present invention relates to a firearm silencer, including a substantially cylindrical outer sheath having a first end and a second end, a barrel hole in the first end of the outer sheath, a damping element inside said outer sheath and connection means for connecting the silencer to a firearm barrel. The connection means include at least one clamping surface adapted to be pressed against the outer surface of said barrel. Further said connection means comprise a locking frame, at least one mounting lever hingedly connected to the locking frame and a twisting device functionally connected to the mounting lever for turning the mounting lever. At least one clamping surface is integrated to the mounting lever. Preferably said mounting lever is connected to the locking frame with a swivel axle. Functional connection with the twisting device is arranged in a way that the mounting lever can by turned by using the twisting device.

In a first preferred embodiment of the silencer according to the invention said twisting device comprises a twisting sleeve movably connected to the silencer, said twisting sleeve having an inner surface and an outer surface, said outer surface having a conically tapering tip portion facing the mounting lever.

In a second preferred embodiment of the silencer according to the invention on the edge surface of the barrel hole there are fastening threads, said twisting sleeve has matching threads on its outer surface and the twisting sleeve is screwed into said barrel hole. Preferably around the barrel hole there is a detachable fastening collar and said fastening threads are arranged to said fastening collar. When the barrel of a firearm is inserted into the barrel hole and the twisting sleeve is rotated around its rotational axis, the twisting sleeve moves in the axial direction of the barrel. Simultaneously the conically tapering tip portion of the sleeve moves into the gaps between the outer surface of the barrel and mounting levers.

In yet another preferred embodiment of the silencer according to the invention on the inner surface of the twisting sleeve there is at least one detachable sealing ring. Preferably, on the inner surface of the twisting sleeve there is at least one groove and said detachable sealing ring is fitted into said groove. The inner surface of the twisting sleeve is facing the outer surface of the barrel, when the barrel is inserted into the barrel hole. The sealing ring seals the gap between the inner surface of the twisting sleeve and the outer surface of the barrel preventing dust and debris entering inside the silencer. Further, the sealing ring acts a gliding element which ensures, that the twisting sleeve does not scratch the surface of the barrel when it moves along the barrel.

In yet another preferred embodiment of the silencer according to the invention said connection means comprise two, three or four mounting levers, which levers are radially connected to the locking frame in a way, that the clamping surfaces of the mounting levers settle on a circular formation. The mounting levers can be moved to a first position in which the fictional circular arc, on which the clamping surfaces are situated, is slightly bigger that the outer circumference of the firearm barrel, to which the silencer is intended to be connected. When the mounting levers are in the first position the firearm barrel can enter into silencer through the barrel hole. By rotating the twisting sleeve around its rotational axis, the mounting levers can be moved to a second position in which the clamping surfaces are pressed tightly against the outer surface of the barrel.

In yet another preferred embodiment of the silencer according to the invention the locking frame and the mounting levers are inside said cylindrical outer sheath.

In yet another preferred embodiment of the silencer according to the invention at least one clamping surface is fixedly integrated to the locking frame. For example, the silencer may include one clamping surface fixedly integrated to the locking frame and two mounting levers, each having an integrated clamping surface. Alternatively, the silencer may include two fixedly integrated clamping surfaces in the locking frame and only one mounting lever with an integrated clamping surface. By moving the position of the mounting lever/levers, the barrel may be clamped between the fixedly connected and the movable clamping surfaces.

In yet another preferred embodiment of the silencer according to the invention said locking frame is fixedly connected to the outer sheath, preferably by welding. Alternatively, said locking frame may be detachably connected to the outer sheath, preferably by threaded connection means.

In yet another preferred embodiment of the silencer according to the invention said damping element has a perforated inner pipe and a centering bushing at the first end of the inner pipe. Said centering bushing has a conical end surface for receiving the end of a firearm barrel. Conical end surface of the centering bushing ensures, that the bushing can receive and tightly joint to barrels having different sized end diameters. Said centering bushing may be attached to the damping element in a detachable manner. By using detachable attachment, bushings customised to specific firearms can be used. Preferably, the centering bushing is made of soft metal or alloy, such as bronze or of plastics, such as nylon.

BRIEF DESCRIPTION OF DRAWINGS

In the following the invention will be described in detail, by way of examples, with reference to the accompanying drawings in which.

DETAILED DESCRIPTION

Figure 1:
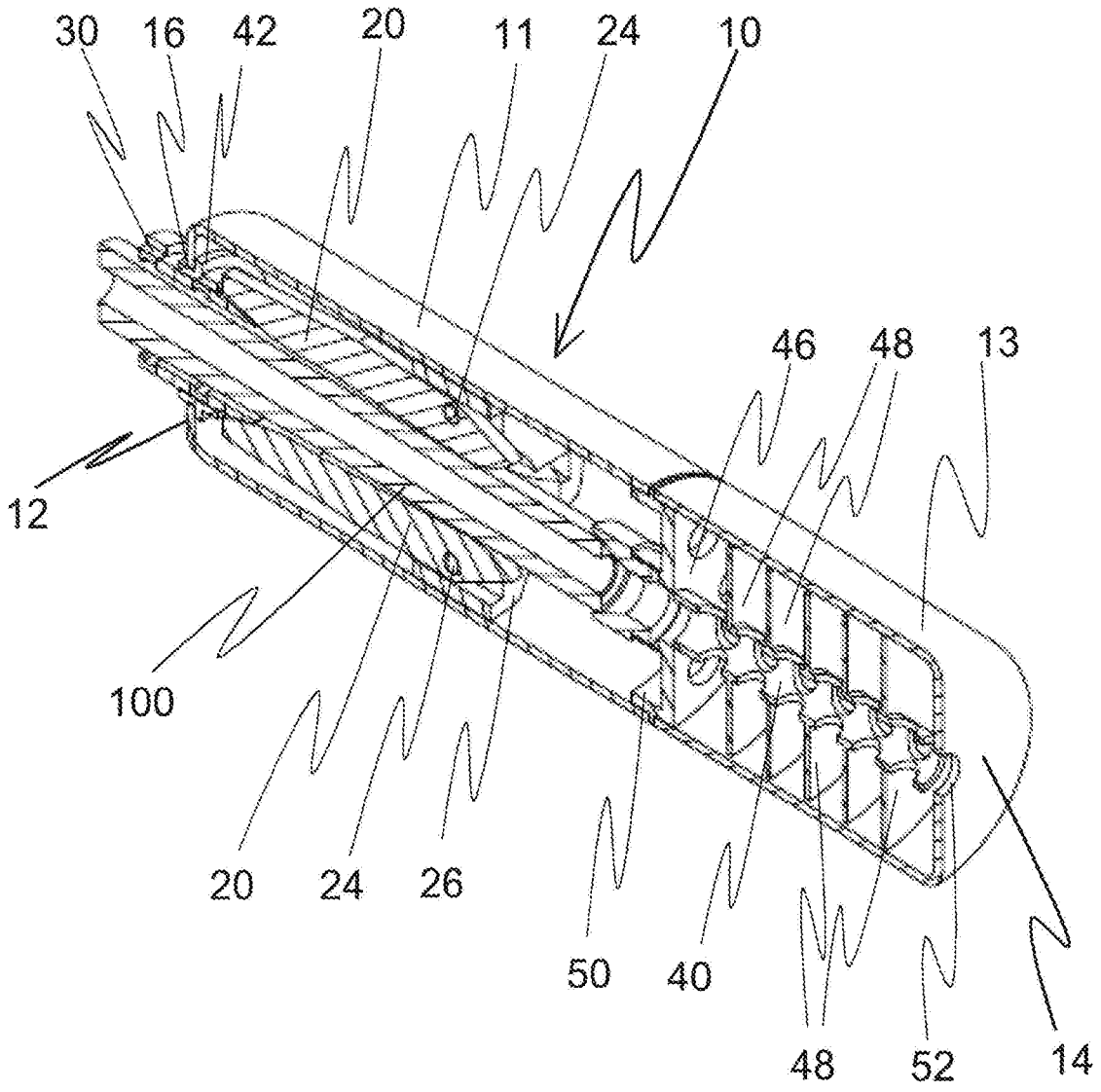
FIG. 1 shows a cross-sectional view of the silencer according to the invention seen obliquely from the side and FIG. 2*a* shows a partial cross-sectional view of the silencer depicted in FIG. 1, when the mounting levers are in a first position

In FIG. 1 an example of a silencer according to invention is shown. The silencer comprises a substantially cylindrical outer sheath 10 having a first end and a second end. At the first end on the outer sheath there is a first end plate 12 and at the second end of the outer sheath there is a second end plate 14. In the middle of the first end plate there is a barrel hole 16 and around the barrel hole there is a detachable fastening collar 42. In the middle of the fastening collar there is a short tube-like aperture, through which an end of a barrel 100 of a firearm is inserted into the outer sheath 10. Around the barrel there is a tubular twisting sleeve 30. The heel portion of the twisting sleeve is on the outer side of the outer sheath, the tip portion of the twisting sleeve is on the inner side of the outer sheath and the middle portion of the twisting sleeve is surrounded by the fastening collar. In the middle of the second end plate there is an orifice 52, through which projectiles will leave the silencer when the firearm has been fired.

Inside the outer sheath at the second end of the sheath there is a damping element, which comprises a perforated inner pipe 40. At the first end on the inner pipe there is a head plate 46 having cylindrical collar 50 around its outer edge. The outer sheath is composed of two cylindrical parts, a first part 11 and a second part 13. The first part has an open second end having threads on its inner surface, the second part has an open first end having threads on its inner surface and the cylindrical collar 50 has threads on its outer surface. The first part is connected to the damping element by screwing the collar 50 partly inside the open end on the first part and the second part is connected to the damping element by screwing the collar 50 partly inside the open end of the second part. Thus, the collar and the threaded inner surfaces of the first and second parts act as connection means with which the first part and the second part are detachably connected together.

Between the head plate 46 and the second end of the inner pipe 40 there are middle plates 48, which divide the space between the head plate and second end plate 14 into chambers. When a shot is fired with the firearm, the exhaust gases formed are discharged into the chambers through the openings in the wall of the perforated inner pipe. Between the chambers there are flow routes, which allow the exhaust gas to flow between the chambers inside the outer sheath to equalize the exhaust gas pressure. The flow routes may include holes in the head plate and middle plates and/or gaps between the outer edge of the middle plates and the inner surface of the outer sheath. The exhaust gases flow out of the outer sheath through the orifice 52 in the second end plate.

Inside the first part 11 of the outer sheath 10 there is a locking frame 26 and four mounting levers 20 radially surrounding the barrel 100. Each mounting lever 20 is hingedly connected to the locking frame with a swivel axle 24. The locking frame is dimensioned to fit tightly inside the outer sheath 10, i.e. the locking frame has frame parts which abut against the inner surface of the outer sheath. The locking frame is fixedly connected to the outer sheath by welding. Alternatively, the locking frame may be connected the outer sheath detachably, e.g. by matching threads on the abutting surfaces of the locking frame and the outer sheath 10.

Figure 2A:
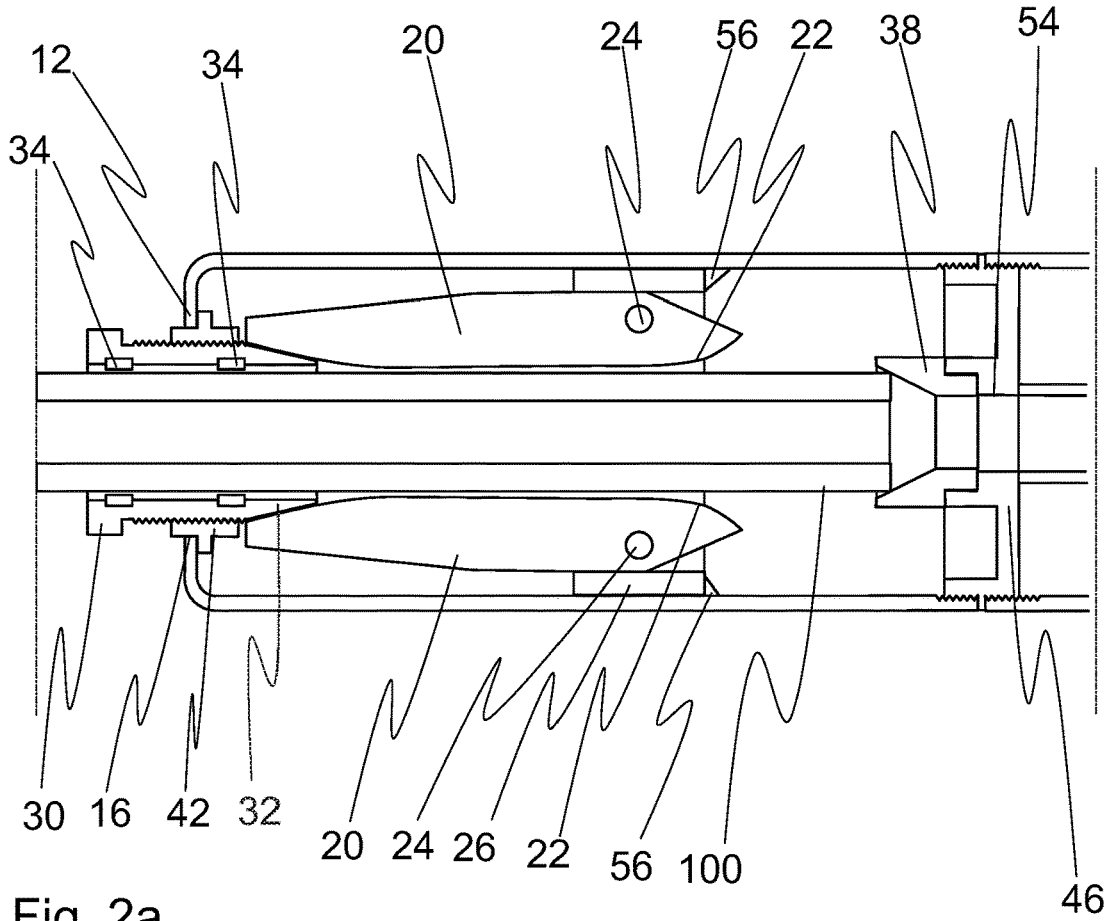
Figure 2B:
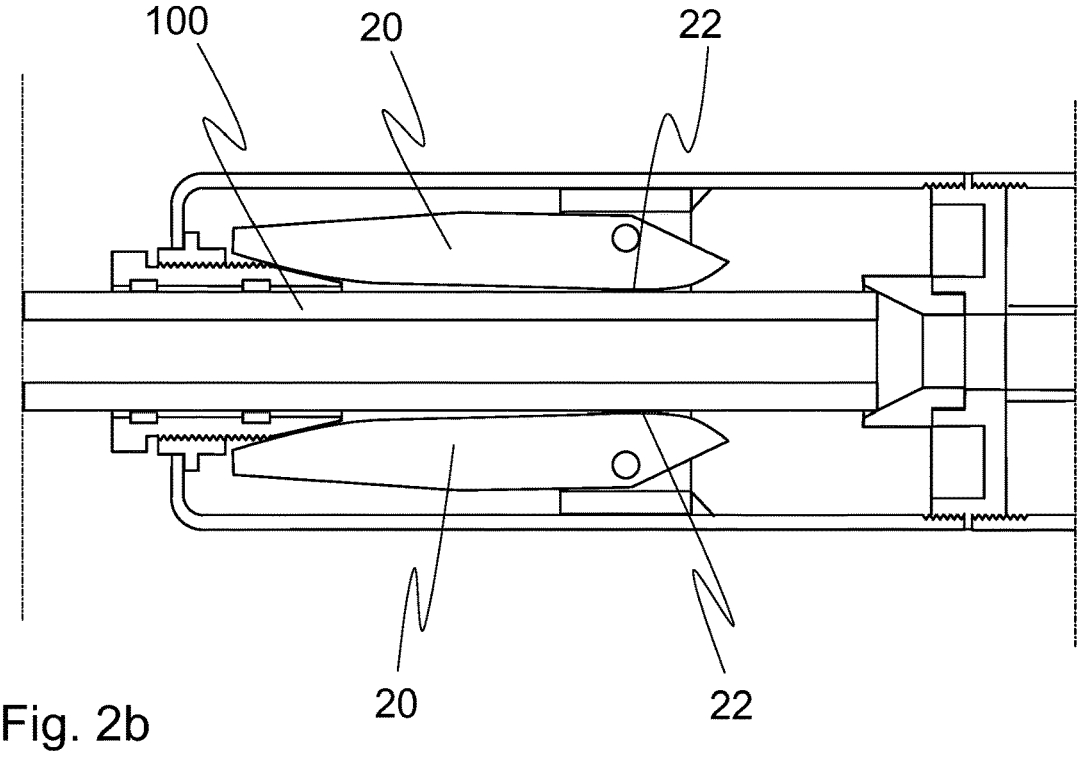
FIG. 2*b* shows a partial cross-sectional view of the silencer depicted in FIG. 1, when the mounting levers are in a second position.

In FIGS. 2*a* and 2*b* a partial cross-sectional view of the silencer depicted in FIG. 1 is shown. In the middle of the head plate 46 there is an aperture 54, into which a centering bushing 38 is installed. The centering bushing has a tubular first end which is tightly fitted inside the aperture 54 in a detachable manner. When the barrel 100 of a firearm is inserted into the silencer, the end of a firearm barrel 100 is abutted against the centering bushing. The centering bushing has a conical end surface for receiving the barrel end. Conical end surface of the bushing ensures, that the bushing can receive and tightly joint to barrels having end diameters of different size.

When the end of the barrel is tightly pressed against the conical end surface, the barrel and the inner pipe 40 of the silencer are aligned. The centering bushing is made of soft metal or alloy, such as bronze or of plastics, such as nylon.

The locking frame 26 is located inside the first part 11 of the outer sheath 10 and connected to the inner surface of the outer sheath by weld seams 56. Four mounting levers 20 are connected to the locking frame 26 with a swivel axle 24 in a way, that the levers radially surround the barrel 100 (only two mounting levers are visible in FIGS. 2*a* and 2*b*). Each mounting lever has a first end near the first end plate 12, a second end near the head plate 46 and an edge surface facing the barrel 100 and extending from the first end to the second end of the lever. The edge surface of the mounting lever has a curved first end portion in the first end of the lever, a curved second end portion in the second end of the lever and a substantially straight middle portion between the curved end portions. The second end portion constitutes a clamping surface 22, which is pressed against the outer surface of the barrel, when the silencer is attached in place to a firearm.

In the first end plate 12 there is a fastening collar 42 fitted tightly inside and surrounding the barrel hole 16. The fastening collar has a tubular, threaded inner surface. Surrounded by the fastening collar there is a tubular twisting sleeve 30 having heel portion outside the outer sheath, a conical tip portion inside the outer sheath and a cylindrical middle portion surrounded by the fastening collar. The tip portion enters to the gap between the first end portions of the edge surfaces of the mounting levers 20. The twisting sleeve has a cylindrical inner surface facing the outer surface of the barrel. In the inner surface there are two grooves, each encompassing a detachable sealing ring 34. On the outer surface of the middle portion there are threads matching the threads of the fastening collar. The heel portion acts as a handle, by which the twisting sleeve can be rotated by hand around the barrel, whereby the twisting sleeve moves in the longitudinal direction of the barrel in relation of the fastening collar. Sealing rings 34 act as gliding elements, which enables the twisting sleeve to slide along the barrel without scratching the surface of the barrel.

The clamping surfaces of the mounting levers 20 settle on a circular formation around the barrel. By rotating the twisting sleeve to a first rotating direction the conical tip portion is forced deeper to the gap between the edge surface of the mounting lever and the outer surface of the barrel causing the mounting lever to turn around the swivel axle 24. When the first end of the mounting moves away of the barrel 100, the second end of the lever, and the clamping surface 22 therein, moves towards the barrel. Correspondingly, when the twisting sleeve is rotated to a second rotating direction, the first end of the mounting can move towards the barrel 100, whereby the clamping surface 22 moves away from the barrel.

The distance between the first end of the mounting lever 20 and the swivel axle 24 defines a first lever arm and the distance between the second end of the mounting lever and the swivel axle defines a second lever arm. In the present invention the first lever arm is substantially longer than the second lever arm. Preferably, the first lever arm is at least four times, more preferably at least five times and most preferably at least six times the length of the second lever arm. Therefore, only a small amount of force is needed to rotate the twisting sleeve 30 to achieve a high clamping force on the clamping surfaces 22. When the curved clamping surfaces 22 are pressed against the outer surface of the barrel, they simultaneously roll on the barrel surface and pull the end of the barrel towards the centering bushing 38 ensuring tight abutment joint with the barrel and the bushing.

In FIG. 2*a* the mounting levers are in a first position where the middle portions of the edge surfaces of the mounting levers are substantially parallel. When the mounting levers are in first position the circular space surrounded by the mounting levers is at largest and the firearm barrel 100 can easily enter inside the silencer. When the twisting sleeve is rotated around the barrel, the mounting levers turn around the swivel axles and the barrel is clamped between the camping surfaces 22 surrounding the barrel. FIG. 2*b* depicts a situation, where the mounting levers are in a second position, where the clamping surfaces are pressed tightly against the outer surface of the barrel locking the silencer in place to the end of the barrel.

In the silencer depicted in FIGS. 1, 2*a* and 2*b* there is four mounting levers. However, the number on mounting levers not limited to four. In some embodiment of the silencer, the number on the mounting levers can be three, five, six or more than six.

Some preferred embodiments of the silencer according to the invention have been disclosed above. The invention is not limited to the solutions explained above, but the inventional idea can be applied in different ways within the limits set by the patent claims.

REFERENCE SIGNS

10 outer sheath
11 first part
12 first end plate
13 second part
14 second end plate
16 barrel hole
20 mounting lever
22 clamping surface
24 swivel axle
26 locking frame
30 twisting sleeve
32 tip portion
34 sealing ring
38 centering bushing
40 inner pipe
42 fastening collar
46 head plate
48 middle plate
50 collar
52 orifice
54 aperture
56 weld seams
100 barrel

The invention claimed is:

1. A firearm silencer, including a substantially cylindrical outer sheath having a first end and a second end, a barrel hole in the first end of the outer sheath, a damping element inside said outer sheath and connection means for connecting the silencer to a firearm barrel, wherein said connection means include at least one clamping surface adapted to be pressed against an outer surface of said firearm barrel, wherein said connection means comprise a locking frame, at least one mounting lever hingedly connected to the locking frame and a twisting device functionally connected to the mounting lever for turning the at least one mounting lever, and said at least one clamping surface is integrated to the at least one mounting lever, and wherein said twisting device comprises a twisting sleeve movably connected to the cylindrical outer sheath of the silencer, said twisting sleeve having an inner surface and an outer surface, said outer surface having a conically tapering tip portion facing the at least one mounting lever.

2. The firearm silencer according to claim 1, wherein said at least one mounting lever is connected to the locking frame with a swivel axle.

3. The firearm silencer according to claim 1, wherein on an edge surface of the barrel hole there are fastening threads, said twisting sleeve has matching threads on the outer surface thereof and the twisting sleeve is screwed into said barrel hole.

4. The firearm silencer according to claim 3, wherein around the barrel hole there is a detachable fastening collar and said fastening threads are arranged to said fastening collar.

5. The firearm silencer according to claim 1, wherein on the inner surface of the twisting sleeve there is at least one detachable sealing ring.

6. The firearm silencer according to claim 5, wherein on the inner surface of the twisting sleeve there is at least one groove and said at least one detachable sealing ring is fitted into said at least one groove.

7. The firearm silencer according to claim 1, wherein said at least one mounting lever comprises three or four mounting levers radially connected to the locking frame, wherein the at least one clamping surface comprises a corresponding clamping surface integrated to each of the three or four mounting levers, and wherein each of the corresponding clamping surfaces are adapted to settle against the outer surface of said firearm barrel.

8. The firearm silencer according to claim 1, wherein the locking frame and the at least one mounting lever is inside said cylindrical outer sheath.

9. The firearm silencer according to claim 1, wherein said connection means further include at least one clamping surface fixedly integrated to the locking frame.

10. The firearm silencer according to claim 1, wherein said locking frame is fixedly connected to the outer sheath.

11. The firearm silencer according to claim 1, wherein said locking frame is detachably connected to the outer sheath.

12. The firearm silencer according to claim 1, wherein said damping element has a perforated inner pipe and a centering bushing at a first end of the perforated inner pipe said centering bushing having a conical end surface for receiving an end of the firearm barrel.

13. The firearm silencer according to claim 12, wherein said centering bushing is attached to the perforated inner pipe in a detachable manner.

14. The firearm silencer according to claim 12, wherein the centering bushing is made of soft metal or alloy or of plastics.

* * * * *